US007703444B2

(12) United States Patent
Schondorf et al.

(10) Patent No.: US 7,703,444 B2
(45) Date of Patent: Apr. 27, 2010

(54) FUEL VAPOR MANAGEMENT FOR STORED FUEL USING FLOATING PARTICLES

(75) Inventors: Steven Schondorf, Dearborn, MI (US); Scott Gaboury, Ann Arbor, MI (US); Craig Stephan, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 593 days.

(21) Appl. No.: 11/160,672

(22) Filed: Jul. 5, 2005

(65) Prior Publication Data

US 2007/0006852 A1 Jan. 11, 2007

(51) Int. Cl.
*F02M 33/02* (2006.01)
*F02M 33/08* (2006.01)

(52) U.S. Cl. ..... 123/518

(58) Field of Classification Search ..... 123/516, 123/518, 519, 520, 198 D
See application file for complete search history.

(56) References Cited

U.S. PATENT DOCUMENTS 2,074,959 A * 3/1937 Guest ..... 73/290 R
3,693,825 A * 9/1972 Richman ..... 220/227
4,615,455 A * 10/1986 Tansill ..... 220/88.1
5,056,493 A 10/1991 Holzer
5,596,971 A 1/1997 Kidokoro
5,722,374 A 3/1998 Kidokoro et al.
5,975,331 A 11/1999 Ishikawa
5,979,481 A 11/1999 Ayresman
6,260,544 B1 7/2001 Spry et al.
6,360,729 B1 3/2002 Ellsworth
6,412,476 B1 7/2002 Thompson et al.
6,904,943 B2 * 6/2005 Dennis ..... 141/1

FOREIGN PATENT DOCUMENTS

JP 06286482 A * 10/1994
JP 06286582 A 10/1994

OTHER PUBLICATIONS

What Is a Tessellation? [online], [retrieved on Oct. 10, 2006]. Retrieved from the Internet:<URL:http://mathform.org/sum95/suzanne/whattess.html>.*
Polyhedron [online], [retrieved on Oct. 10, 2006]. Retrieved from the Internet:<URL:http:/mathworld.worlfram.com/Polyhedron.html>.*

* cited by examiner

*Primary Examiner*—Mahmoud Gimie
(74) *Attorney, Agent, or Firm*—Julia Voutyras; Brooks Kushman P.C.

(57) ABSTRACT

A system, method, and article of manufacture for reducing the rate of fuel vapor formation within a fuel storage tank include a plurality of discrete independent floating particles or elements to reduce exposed evaporative surface area of fuel in the fuel storage tank while conforming to a changing fuel tank cross-section as fuel level changes. The elements or particles may have a self-tessellating geometry to facilitate formation of a single or multi-layer barrier or cover and be made or coated with a material that resists fuel wetting and degradation, such as a highly fluorinated polymer including polytetrafluoroethylene.

18 Claims, 3 Drawing Sheets

FUEL VAPOR MANAGEMENT FOR STORED FUEL USING FLOATING PARTICLES

BACKGROUND OF THE INVENTION

1. Field of the Invention

The present invention relates to systems and methods for reducing fuel vapor produced by stored fuel.

2. Background Art

Evaporation of fuel in a fuel tank produces fuel vapor that must be managed to reduce or eliminate releasing of the vapor to the atmosphere. Modern automotive fuel systems have a complex system that typically includes a vapor recovery canister to capture and subsequently purge fuel vapors. While this technology has evolved to an efficient and effective system for managing fuel vapor in vehicles powered by a conventional internal combustion (IC) engine, it is not readily amenable for use in hybrid electric vehicles that utilize an IC engine and an electric motor, particularly during periods when the vehicle is operating with the IC engine off. The IC engine in a hybrid electric vehicle may run only 50% or less of a typical driving cycle yet the amount of fuel vapor that needs to be managed is similar to a conventional IC engine vehicle.

A number of solutions have been proposed to reduce fuel vapor generation that include a bladder or other flexible barrier to separate the liquid fuel from the surrounding fuel vapor in the fuel storage tank, such as disclosed in U.S. Pat. Nos. 5,056,493; 5,596,971; 5,722,374; and 6,260,544, for example. While suitable for many applications, these solutions typically require more sophisticated control and increased complexity with an associated increased cost while reducing the available volume for fuel. In addition, these solutions must be integrated into the vehicle fuel control system and are not amenable to use in existing fuel systems.

SUMMARY OF THE INVENTION

The present invention includes a system, method, and article of manufacture for reducing the rate of fuel vapor formation within a fuel storage tank via a plurality of discrete floating particles or elements to reduce exposed evaporative surface area of fuel in the tank. The discrete particles conform to a changing fuel tank cross-section as fuel level changes. The elements or particles may have a simple spherical geometry and/or have a two- or three-dimensional self-tessellating geometry, such as a cube, prismatic triangle, or prismatic hexagon to facilitate formation of a single or multi-layer liquid-vapor barrier and be made or coated with a material that resists fuel wetting and degradation, such as a highly fluorinated polymer including polytetrafluoroethylene (Teflon). In various embodiments of the invention, the particles have a geometry including an apex and a weighted base to provide a desired orientation while floating on or near the surface of the fuel to facilitate shedding of liquid fuel. Representative geometries include a pyramid, cone, or triangular prism, for example. Particles having different but complementary properties may be used in a particular application to facilitate barrier formation and fuel tank conformity.

The present invention provides a number of advantages. For example, the present invention reduces vapor formation rate without the added complexity and cost associated with many alternative solutions. In addition, the present invention may be installed through the fuel filling port so that it may be used in both new and existing fuel systems with compatible fuel delivery components. The floating elements or particles of the present invention form an independent covering or barrier that conforms to the changing local cross-section of the fuel tank, which depends upon fuel height, while improving fuel storage capacity relative to previous approaches. Appropriate material selection for the floating particles according to the present invention minimizes wetting of the exposed surface of the particle barrier to reduce or prevent this surface as a source of vapor formation and may reduce or eliminate any noise associated with particles contacting fuel system components and/or other particles.

The above advantages and other advantages and features of the present invention, will be readily apparent from the following detailed description of the preferred embodiment(s) of the invention when taken in connection with the accompanying drawings.

DETAILED DESCRIPTION OF THE PREFERRED EMBODIMENT(S)

Figure 1:
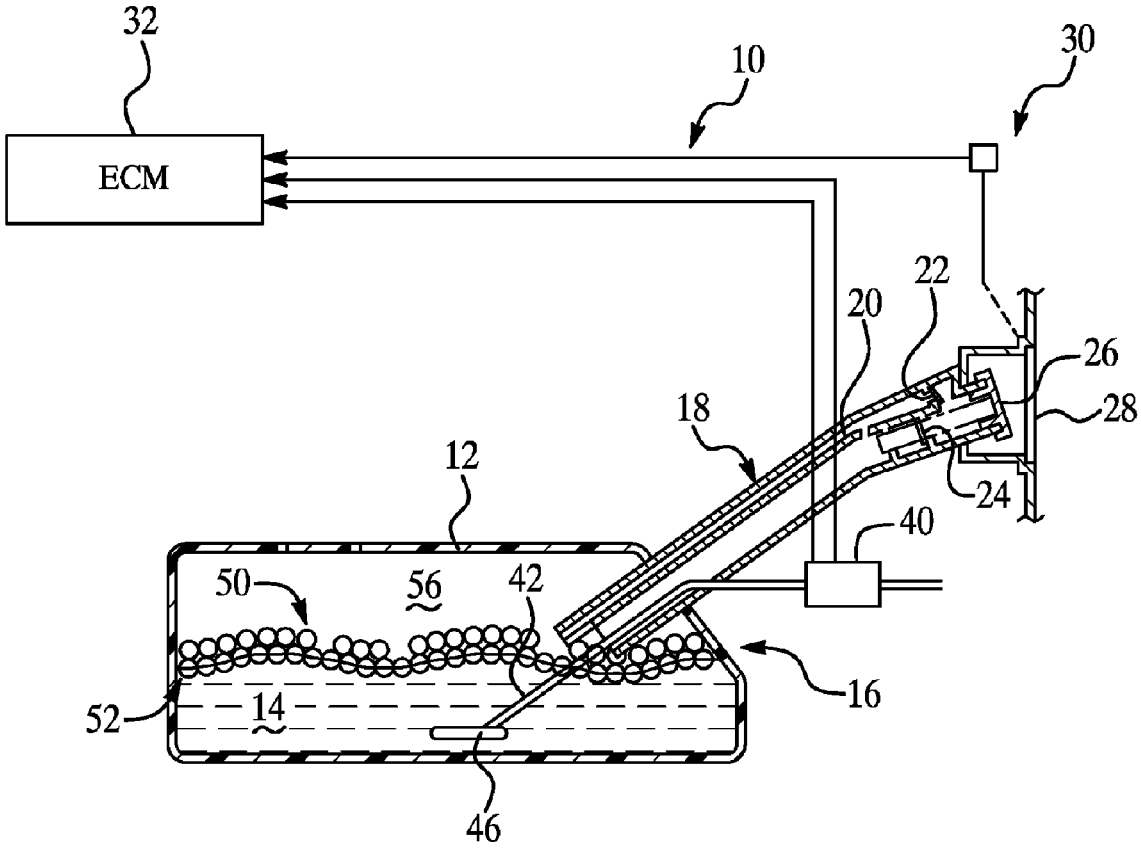
FIG. 1 is a partial cross-section of a representative fuel system illustrating a system or method for reducing fuel vapor formation according to one embodiment of the present invention.

FIG. 1 is a partial cross-section of a representative fuel system illustrating a system or method for reducing the rate of fuel vapor formation according to one embodiment of the present invention. Although the present invention is illustrated and described with respect to a representative automotive fuel system 10, those of ordinary skill in the art will recognize that the present invention may be used in a number of diverse applications that include a volatile liquid stored in a rigid or semi-rigid storage tank to reduce vapor formation rate by reducing exposed evaporative surface area.

Representative fuel system 10 includes a semi-rigid or rigid container or tank 12 adapted for holding liquid fuel 14. Tank 12 may have a varying cross-section to maximize fuel storage capacity while accommodating packaging constraints for a particular application. Fuel filling tube 18 may include a vapor recirculation channel 20 and vent valve 22 to manage vapor generation during fuel filling. Various other known vapor management devices and controls, such as a vapor recovery canister (not shown), may also be provided depending upon the particular application. However, as described herein, use of the present invention may obviate the need for some or all of these conventional vapor management devices, or alternatively reduce the required vapor containment capacity of such systems by reducing the vapor formation rate within tank 12. Fuel system 10 also includes a filling tube flap 24, fuel cap 26 and fuel compartment door 28. Various fuel system sensors and actuators, such as fuel door sensor 30, may communicate with an engine or vehicle control module (ECM) 32 to provide fuel system information and control. ECM 32 communicates with a fuel pump 40 that pumps liquid fuel through delivery tube 42 to the engine (not shown). Depending upon the particular application and implementation, fuel pump 40 may be disposed within tank 12 rather than externally position as illustrated. An integral or separate fuel screen, cage, filter or similar device 46 is provided to prevent floating particles 50 and/or debris from entering fuel delivery tube 42.

According to the present invention, a plurality of elements or particles 50 float in liquid fuel 14 at or near the fuel surface 52 to reduce the evaporative surface area of liquid fuel 14 exposed to fuel vapor space 56 within tank 12 to reduce the rate of vapor formation within tank 12. As described in greater detail herein, the shapes and sizes of particles 50 may be selected for a particular application to reduce or minimize vapor to liquid fuel contact, minimize impact to tank capacity, and minimize impact to the fuel filling and intake/delivery systems, i.e. large enough so that the particles are not inducted by the fuel pump and do not impede fuel flow, but small enough to maximize their ability to cover irregularly-shaped sections of the fuel surface at the tank interface and around any fuel system components within the tank. For a representative application having particles with a spheroid or spherical geometry, particles may be about 1-2 cm in diameter, for example. Of course the actual particle geometry and size may vary and particles of different size, geometry and/or other particle properties may be used together for a particular application. Selection of particular particle properties including material, size, geometry, etc. may be determined based on many application and implementation specific considerations, including but not limited to the cost to manufacture particles with particular properties relative to the efficiency or performance in reducing the rate of vapor formation for a particular fuel and/or application.

As illustrated in FIG. 1, spheroid floating particles 50 cover the surface area of liquid fuel 14 to form a liquid-vapor barrier that conforms to the changing cross-section 16, and any local obstructions including filling tube 18 and delivery tube 42, for example, of tank 12 as the level of liquid fuel 14 changes. Particles 50 may be sized to allow introduction into tank 12 through fuel filling tube 18 or other small opening so that particles 50 may be added either during assembly of tank 12, or to existing fuel systems with compatible fuel delivery components. Some incompatible existing fuel systems may be amenable to retrofitting by addition of an appropriate screen or similar device to prevent particles 50 from affecting any fuel delivery system components. System 10 includes a fuel filling tube or port 18 to supply liquid fuel 14 to tank 12.

In some applications, tank 12 may include one or more spaces that will not fill with fuel even when the tank is filled "to capacity", i.e. when the fuel filling tube is full and can not accept additional fuel. Whether such spaces are included by design to provide mounting locations or for other considerations, or are an unintended result, the floating particles of the present invention will likely migrate to those locations when the tank is filled with fuel such that use of the present invention does not adversely impact the useable fuel volume by addition of the floating particles in these applications.

Floating particles 50 cover the surface 52 of liquid fuel 14 in one or more layers to create a barrier that reduces the exposed evaporative surface area. Particles 50 may have any of a number of geometries including simple balls or spheroids as shown in FIG. 1, or more complex geometries such as those illustrated in FIGS. 2-6, for example, which may more efficiently cover the changing surface area of the fuel. The particle geometry may be selected so that the particles tend to shed liquid fuel and resist formation of any fuel film on their upper surface that would be exposed to vapor containing space 56 and contribute to additional vapor formation. Similarly, particles 50 may be made of or coated with a low surface energy material that the liquid fuel does not wet or degrade, such as a highly fluorinated polymer like polytetrafluoroethylene (also known as Teflon). Particles 50 may be solid, foamed, and/or hollow to provide a desired buoyancy to float at or near the surface of the fuel. The thickness or number of layers created by floating particles having approximately the same buoyancy can be selected based on the size and quantity of particles disposed within the tank relative to the surface area of the fuel. If desired, particles having different buoyancy may be used together to facilitate formation of a multi-layer barrier at or near the fuel surface, with one group of particles having a buoyancy to float just below the surface and additional groups having a buoyancy to float above or below the first group, for example. Similarly, while floating particles have a tendency to cluster and exhibit some small attractive force, likely related to the surface tension of the liquid and/or surface adhesion of the wetted floating elements, some or all of the particles may include one or more properties or features to provide a supplemental attractive (or repulsive) force to improve the efficiency of the barrier formation and subsequent integrity of the barrier under varying operating conditions. In addition, supplemental lateral attractive (and/or repulsive) properties may be used to reduce or eliminate any noise otherwise created by particles colliding with obstructions or each other. The attractive or repulsive force should be mostly lateral in direction and weak in magnitude relative to the force associated with the particle buoyancy so that the particles form a layer or layers conforming to the fuel surface and do not cluster into a sphere. Appropriate selection of material properties can be used to make the floating particles slightly attractive to each other and slightly repelled from the tank walls or other fuel system components, for example. As one example, some or all of the particles may be lightly magnetized to facilitate barrier formation, retention, and noise reduction particularly during mild fuel rippling or sloshing.

Figure 2:
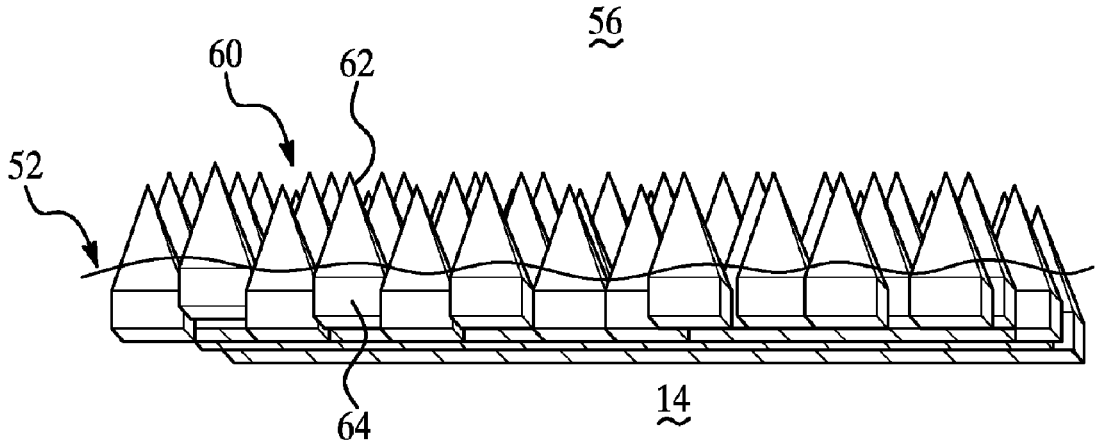
FIG. 2 illustrates one embodiment of floating two-dimensionally tessellating particles or elements including elements having complementary properties to reduce evaporative surface area of stored fuel according to the present invention.

FIG. 2 illustrates one embodiment of floating two-dimensionally tessellating particles or elements 60. As used herein, tessellating or self-tessellating particles or elements have shapes that fit together to substantially fill available space in two or three dimensions with few or no gaps. Of course, in actual applications particles may overlap and cluster into groups and some open areas or gaps may exist at various times. In the example illustrated in FIG. 2, floating elements 60 include a geometry particularly suited for shedding fuel that includes an apex 62 and base 64. Such geometries may include a triangular prism, conical, or pyramidal shape to shed liquid fuel 14 that may splash on the surface. Asymmetrical particles, such as floating elements 60, may include a weighted portion or base 64 to provide a desired orientation while floating. In this example, appropriate weighting of base 64 orients the particle with apex 62 exposed to space 56.

Figure 3:
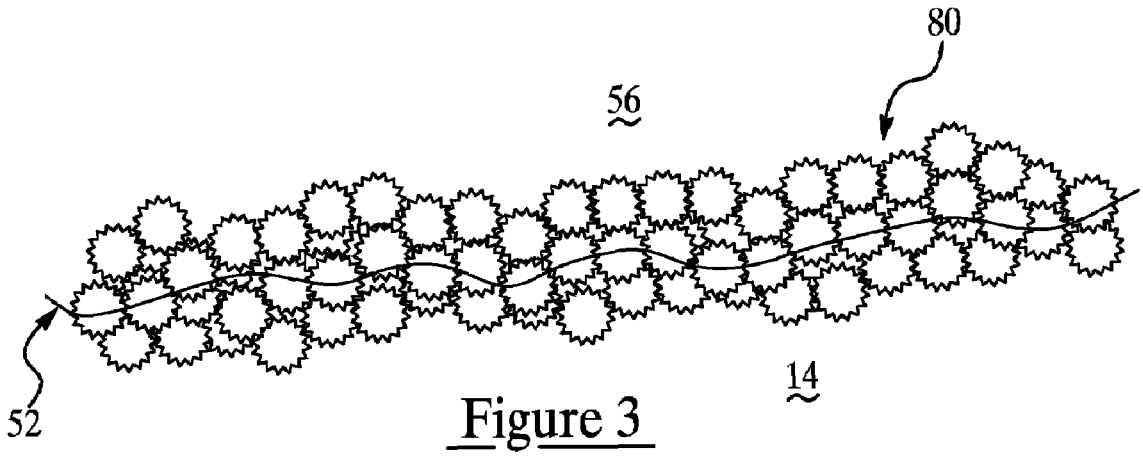
FIG. 3 illustrates an embodiment of three-dimensionally tessellating floating particles having different buoyancy to facilitate formation of a multi-layer liquid fuel cover to reduce vapor formation rate according to the present invention.

FIG. 3 illustrates another embodiment of floating particles with differing buoyancy and stellated geometry to form a multi-layer liquid-vapor barrier to reduce vapor formation rate according to the present invention. Particles 80 comprise star-like or stellated polyhedra, such as rhombic dodecahedra, which are three-dimensionally tessellating, although other types of geometries could also be used with two or more groups having different buoyancy so that one layer with a first buoyancy is formed below or partially below fuel surface 52 with another layer having a second buoyancy formed generally above the first layer to separate liquid fuel 14 from space 56 within the fuel tank.

Figure 4:
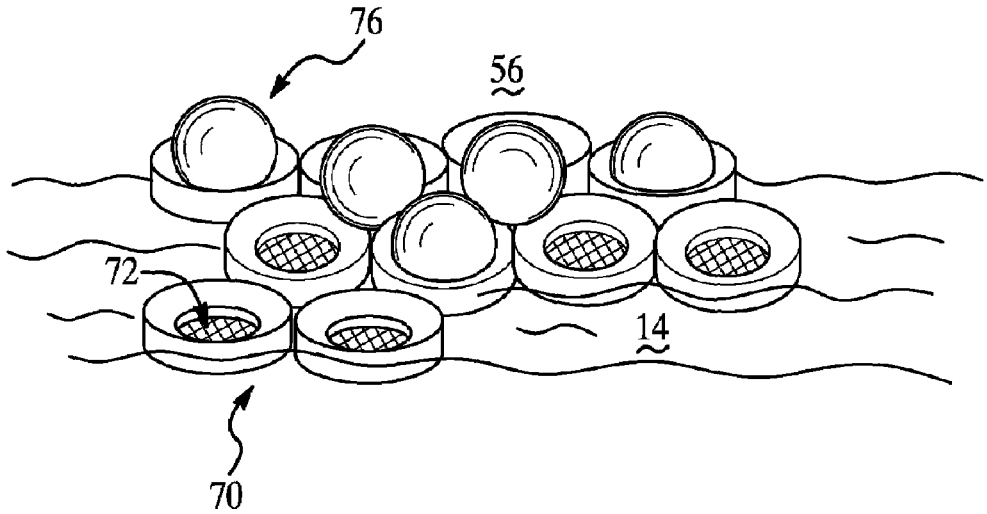
FIG. 4 illustrates combined use of particles having complementary properties according to the present invention.

Depending upon the particular application, two or more groups of particles having other complementary properties may be used together as illustrated in FIG. 4. In this example, particles 70 and 76 include complementary geometries although other complementary properties may be combined in a particular application including different sizes, materials, buoyancy, magnetism, etc. as previously described to facilitate self assembling when floating adjacent one another, and to self-disassemble into a random group when contacting fuel system components or the fuel tank boundary as previously described. First group of particles 70 are shaped like a toroid or torus that may have an opening or hole in the center, or alternatively have a substantially closed surface 72 across the bottom or through the center with a small hole to allow splashed fuel to return to the liquid fuel 14. A second group of particles 76 have a complementary geometry, such as a sphere or spheroid to cover gaps between adjacent toroids and/or rest within the toroids and may facilitate formation of a second layer on top of the toroids, for example.

Figure 5:
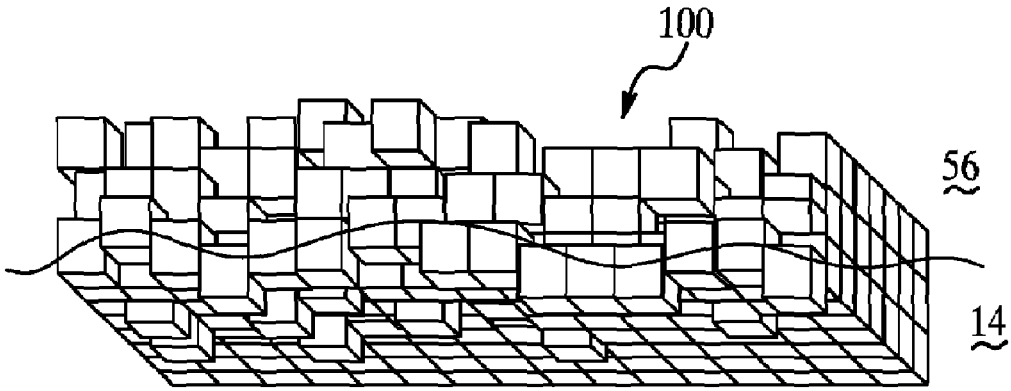
FIG. 5 illustrates another embodiment of three-dimensionally tessellating floating particles according to the present invention.
Figure 6A:
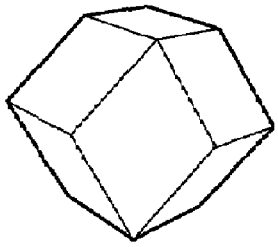
FIGS. 6A-6D illustrate representative alternative geometries for floating particles or elements according to the present invention.
Figure 6B:
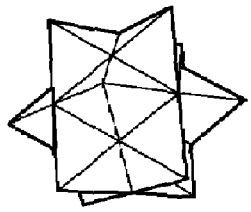
Figure 6C:
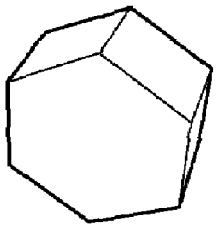
Figure 6D:
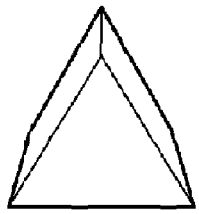

FIG. 5 illustrates another example of three-dimensionally tessellating floating particles having a cubic geometry according to one embodiment of the present invention. If provided in sufficient quantity, such particles 100 will form a multi-layer covering or barrier between liquid fuel 14 and vapor space 56. Alternative representative geometries for floating three-dimensionally tessellating particles for use in reducing vapor formation rate of stored fuel according to the present invention are illustrated in FIGS. 6A-6D. FIGS. 6A and 6B illustrate rhombic and stellated rhombic dodecahedra, respectively. FIG. 6C illustrates a prismatic hexagon and FIG. 6D illustrates a triangular prism. Those of ordinary skill in the art may recognize various other particle properties or characteristics including alternative geometries that are not explicitly illustrated or described but are consistent with the teachings and within the scope of the present invention.

As illustrated and described with reference to FIGS. 1-6, the present invention provides a system, method, and article of manufacture for reducing the rate of vapor formation in a fuel system having a fuel storage tank by reducing exposed evaporative surface area of fuel in the fuel storage tank using a plurality of discrete floating particles or elements that form an independent covering of at least one layer across at least a portion of the surface of the fuel. The particles are essentially free bodies independent of one another and independent of the fuel tank or any fuel system component, but combine to form a fuel covering or barrier on the fuel surface due to intrinsic fluid/particle interactions associated with surface tension and/or surface adhesion effects. Alternatively, particles may include selected physical, chemical, or other properties to provide a desired attractive or repulsive force. The particles may include various geometries and material properties to resist fuel wetting (i.e. shed liquid fuel) and resist degradation. Appropriate buoyancy and/or weighting of particles may be used to provide a desired particle orientation, with one or more types or groups of particles having complementary properties used together to reduce permeability of the liquid-vapor covering or barrier, and/or reduce noise that may be generated by collisions of particles with obstacles or each other.

The present invention reduces vapor formation without the added complexity and cost associated with many alternative vapor management solutions. In addition, the present invention may be installed through the fuel filling port or other small opening so that it may be used in both new and existing fuel systems having compatible (or easily adapted) fuel delivery components. The floating elements or particles of the present invention conform to the changing local cross-section of the fuel tank, which depends upon fuel height, while improving fuel storage capacity relative to previous approaches. Appropriate material selection for the floating particles according to the present invention minimizes wetting of the exposed surface of the particle barrier to reduce or prevent vapor formation While the best mode for carrying out the invention has been described in detail, those familiar with the art to which this invention relates will recognize various alternative designs and embodiments for practicing the invention as defined by the following claims.

What is claimed is:

1. A method for managing fuel vapor in a fuel system having a fuel storage tank, the method comprising:

reducing exposed evaporative surface area of fuel in the fuel storage tank using a plurality of floating particles each having a geometry with at least a portion shaped to facilitate tessellation with other particles, wherein the floating particles include a portion shaped to shed liquid fuel having a geometry with an apex extending to a weighted base to orient the particles with the base toward the liquid fuel.

2. A method for managing fuel vapor in a fuel system having a fuel storage tank, the method comprising:

reducing exposed evaporative surface area of fuel in the fuel storage tank using a plurality of floating particles each having a geometry with at least a portion shaped to facilitate tessellation with other particles; and adding the particles to the fuel storage tank through a fuel filling port.

3. A method for managing fuel vapor in a fuel system having a fuel storage tank, the method comprising:

reducing exposed evaporative surface area of fuel in the fuel storage tank using a plurality of floating particles each having a geometry with at least a portion shaped to facilitate tessellation with other particles, wherein the particles include a three-dimensional tessellating stellated geometry to form at least on layer conforming to at least a partial cross-section of the fuel storage tank corresponding to a current level of fuel.

4. The method of claim 3 wherein the particles include stellated dodecahedra.

5. A fuel storage system comprising:

a container adapted for holding liquid fuel, the container including a fuel filling port and a fuel delivery port; and a plurality of discrete independent particles disposed within the container to float on or near the surface of liquid fuel in the container, at least some of which exhibit a supplementary attractive force to improve formation of a barrier to reduce fuel vapor formation rate within the container.

6. The system of claim 5 wherein the particles comprise self-tessellating particles.

7. The system of claim 5 wherein the particles are weighted to provide a desired orientation while floating.

8. The system of claim 5 wherein the particles are formed of a material having a surface energy that reduces fuel wetting.

9. The system of claim 5 wherein the particles exhibit a primarily lateral attractive force weak in magnitude relative to a force associated with buoyancy of the particles.

10. The system of claim 5 wherein the particles comprise a first group of particles having a first buoyancy to form a first layer of particles and a second group of particles having a second buoyancy to form a second layer of particles.

11. The system of claim 5 wherein at least some of the particles comprise magnetic particles.

12. An article of manufacture for use in a fuel storage tank to reduce fuel vapor formation within the tank, the article comprising:

a particle formed of a material having a surface energy that reduces fuel wetting and having a buoyancy to float at or near the surface of a fuel and having a geometry to facilitate tessellation with other particles to form at least one layer of particles between liquid fuel and space within the tank to reduce evaporative surface area of fuel within the tank.

13. An article of manufacture for use in a fuel storage tank to reduce fuel vapor formation within the tank, the article comprising: a particle weighted to provide a desired orientation while floating and having a buoyancy to float at or near the surface of a fuel and having a geometry to facilitate tessellation with other particles to form at least one layer of particles between liquid fuel and space within the tank to reduce evaporative surface area of fuel within the tank.

14. An article of manufacture for use in a fuel storage tank to reduce fuel vapor formation within the tank, the article comprising:

a particle having a buoyancy to float entirely below the surface of the fuel and having a geometry to facilitate tessellation with other particles to form at least one layer of particles between liquid fuel and space within the tank to reduce evaporative surface area of fuel within the tank.

15. An article of manufacture for use in a fuel storage tank to reduce fuel vapor formation within the tank, the article comprising:

a particle having a buoyancy to float at or near the surface of a fuel and having a three-dimensionally self-tessellating stellated geometry to facilitate tessellation with other particles to form at least one layer of particles between liquid fuel and space within the tank to reduce evaporative surface area of fuel within the tank.

16. A method for managing fuel vapor in a fuel system having a fuel storage tank, the method comprising covering the fuel surface with a first group of floating particles having a first geometry and a second group of floating particles having a second geometry to facilitate formation of at least one layer of particles at or near the fuel surface to reduce exposed evaporative surface of the fuel.

17. A method for managing fuel vapor in a fuel system having a fuel storage tank, the method comprising covering the fuel surface with a plurality of particles, at least some of the particles exhibiting a supplementary attractive force to facilitate clustering of particles to form at least one layer of particles at or near the fuel surface.

18. The method of claim 17 wherein at least some of the particles are magnetic.

* * * * *